US005520226A

United States Patent [19]

Pedrini

[11] Patent Number: 5,520,226

[45] Date of Patent: May 28, 1996

[54] DEVICE FOR SEPARATING RESERVE TURNS OF THREAD ON A WEFT FEEDER DRUM

[75] Inventor: Giovanni Pedrini, Leffe, Italy

[73] Assignee: L.G.L. Electronics S.p.A., Bergamo, Italy

[21] Appl. No.: 300,224

[22] Filed: Sep. 6, 1994

[30] Foreign Application Priority Data

Sep. 10, 1993 [IT] Italy ..... TO93A0662

[51] Int. Cl.[6] ..... D03D 47/36

[52] U.S. Cl. ..... 139/452; 242/47.01

[58] Field of Search ..... 384/447; 139/452; 242/470.01

[56] References Cited

U.S. PATENT DOCUMENTS

| | | | |
|---|---|---|---|
| 4,035,044 | 7/1977 | Miyazaki | 384/447 |
| 4,083,506 | 4/1978 | Mander et al. | 242/25 R |
| 4,632,154 | 12/1986 | Maina | 139/452 |
| 4,747,549 | 5/1988 | Balzarotti | 242/47.01 |
| 5,211,207 | 5/1993 | Ichikawa | 139/452 |

FOREIGN PATENT DOCUMENTS

| | | |
|---|---|---|
| 0244511 | 11/1987 | European Pat. Off. . |
| 0326960 | 8/1989 | European Pat. Off. . |
| 9000149 | 1/1990 | WIPO . |

*Primary Examiner*—Andy Falik
*Attorney, Agent, or Firm*—Guido Modiano; Albert Josif

[57] ABSTRACT

A device for separating reserve turns of thread on a weft feeder drum comprising a swift that is formed by a set of axial rods that partially and variably protrude from respective slots formed on the drum of the feeder by virtue of the compound motion applied to the swift by a bush that is associated with the drive shaft. The bush is supported by a recessed coaxial portion of the drive shaft, and a diametrical pin is provided which is arranged so as to cross said shaft and said bush, and to bring about a pivotal engagement between said shaft and said bush. The bush has a cylindrical and eccentric outer surface and an internal surface that is profiled so as to form two portions of truncated-cone surfaces. The bush can thus oscillate about the pin and be arranged at an angle with respect to the drive shaft. An actuation element is provided to vary the inclination of the bush when the bush is rotated with respect to the element, which is kept fixed by a pushbutton stop device.

9 Claims, 8 Drawing Sheets

FIG.11a
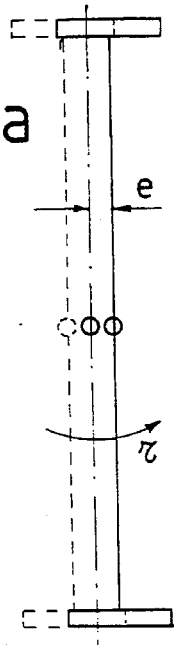
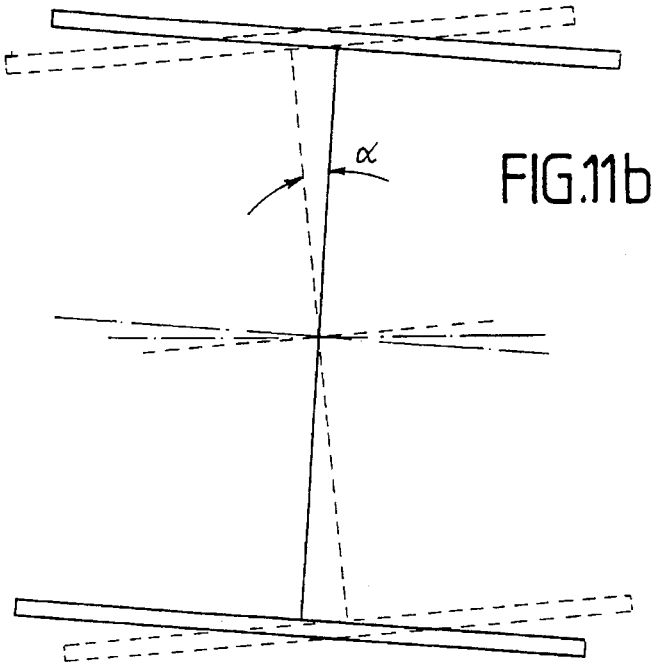
FIG.11b
FIG.11c
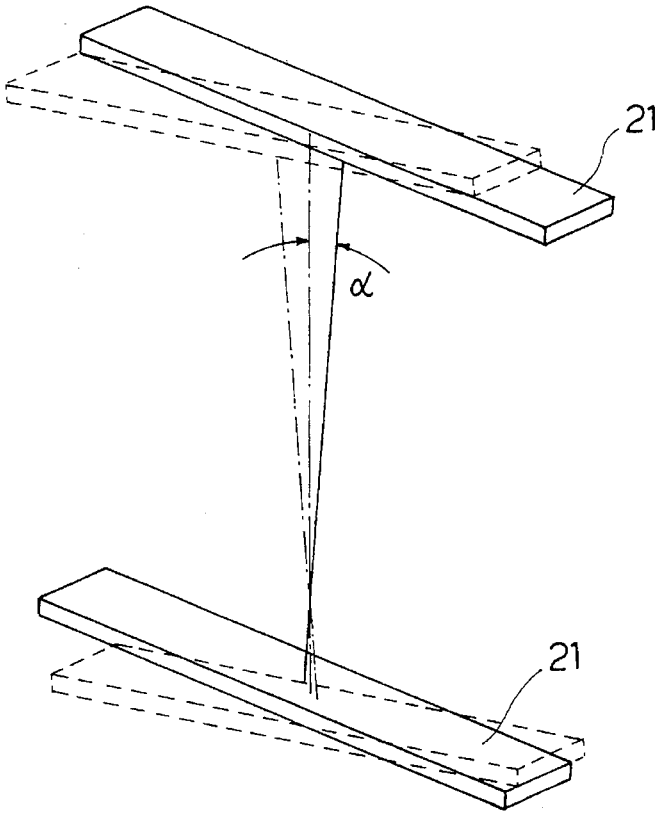

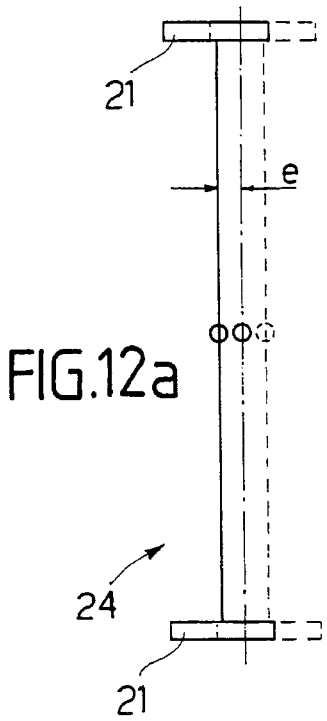
FIG.12a
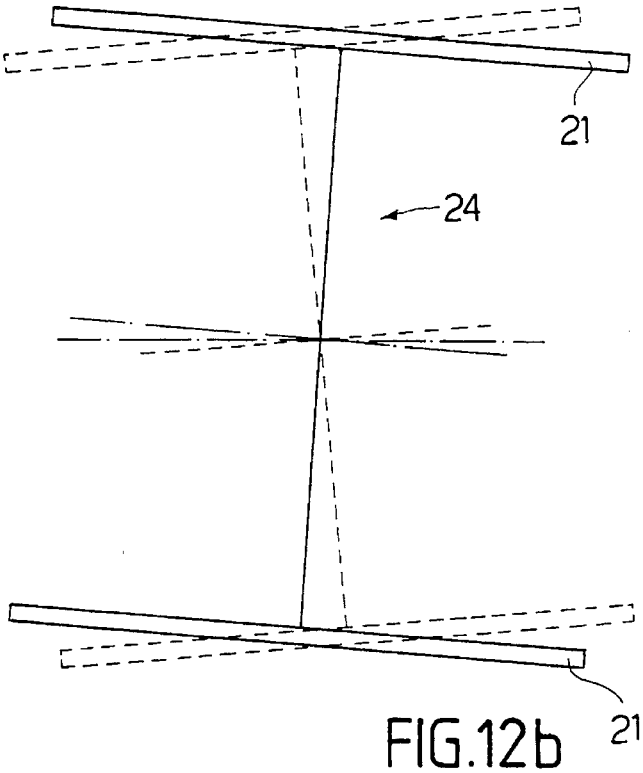
FIG.12b
FIG.12c
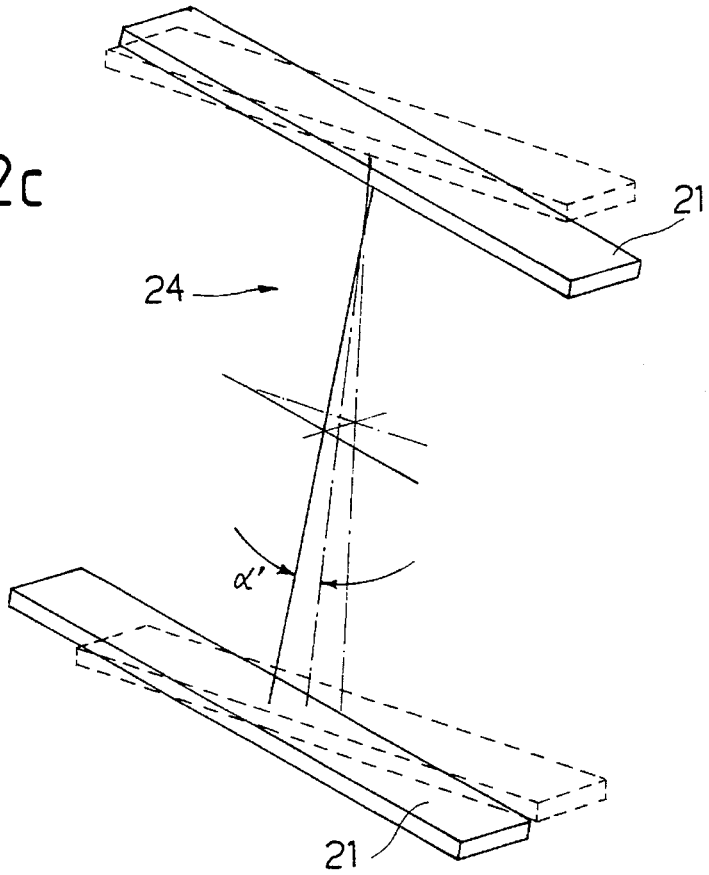

DEVICE FOR SEPARATING RESERVE TURNS OF THREAD ON A WEFT FEEDER DRUM

BACKGROUND OF THE INVENTION

The present invention relates to a device for separating reserve turns of thread for devices that feed weft to weaving looms, particularly shuttle-less gripper, projectile and fluid-jet looms.

As is known, weft feeders for looms of the specified type, or more generally for textile machines, are devices provided with a fixed drum; multiple turns of thread to be fed to the loom are wound at the base of said drum by means of a suitable flywheel which has a windmilling arm rigidly coupled to a drive shaft of the device. These turns constitute a reserve of thread which must be proportionate to the beat rate of the loom to be fed and are unwound from the opposite end—briefly termed dome—of the drum; the turns that are gradually removed are replaced by an advancement system which moves said turns from the base to the dome of the drum, keeping them mutually spaced by a given pitch that determines the number of turns wound, and thus the amount of the thread reserve.

The known and now universally adopted advancement system uses a swift which is formed by a set of rotationally rigidly coupled axial rods which partially and variably protrude from respective axial slots, provided on the drum by virtue of a compound motion which is applied to the swift by the drive shaft of the feeder by means of a tilted bush which is fitted on an eccentric portion of said drive shaft. The motion applied to the swift by said bush and by the eccentric portion of the shaft is substantially the result of a sinusoidal undulatory component and of an oscillatory component on the axial plane and makes the turns of thread advance axially along the drum; the direction of said advancement depends on the direction of the rotation of the drive shaft. Since the turns must always advance from the base towards the dome of the drum, if the direction of the rotation of the drive shaft is changed—for example to adapt the device to threads with left-handed or right-handed twisting—the bush must be correspondingly replaced with another one which is mirror-symmetrical, so as to reverse the inclination of the swift with respect to the drum.

This operation entails disassembling the swift from the drive shaft, extracting the bush of one kind, mounting the bush of the other kind, and reassembling the swift.

In an attempt to obviate this troublesome series of operations that require long downtimes of the feeder, special bushes have been provided which are more simply rotated about their axis and are fixed, by means of transverse locking screws, in two mirror-symmetrical active positions which are angularly spaced by 180°. A bush of this type is described in U.S. Pat. No. 4,632,154.

This known type of bush, however, only partially solves the problem of rapidly adapting the feeder to the various kinds of thread and does not allow to vary the inclination of the swift within intermediate values and thus vary the pitch of the turns wound on the drum.

According to another known solution, described in European patent no. 0,326,960, the eccentric portion of the drive shaft is hollow and a ring with a spherical surface is keyed to it; bush portions rigidly coupled by axial traction elements abut on either side of said ring and are rotationally coupled to it. Each bush portion has an axial hole which is larger in diameter than the eccentric part of the shaft, so that the bush, under the actuation of kinematic movement means which are accommodated within the cavity of the shaft and can be accessed from outside the drum, can rotate on an axial plane with respect to the ring so as to tilt on one side or the other with respect to the axis of said shaft.

Other solutions of this type, which include a tilting bush having a larger internal diameter than the drive shaft, are described in U.S. Pat. No. 4,747,549 and in international patent application WO 90/00149.

Another known solution aimed at achieving the automatic adaptation of the tilt of the bush to the direction of rotation of the drive shaft is described in German patent application no. DE 4105174.

This solution uses a tilted bush which is rotatably mounted on a sleeve that is fitted on the drive shaft and has a slot which is shaped like a 180° circular arc; an actuation pawl cooperates with the slot and engages the one end shoulder of the slot or the other, performing a 180° idle stroke every time the direction of the rotation of the shaft reverses.

Although the above described known devices considerably simplify or automate the operations for adapting the feeder to the different types of thread, they all have the drawback of considerable structural complexity, with the possibility of wear of the kinematic systems that control the tilt of the bush and of the consequent formation of plays which in addition to negatively affecting the correct operation of the device facilitate breakages, reducing the operating reliability of the weft feeder. Furthermore, the above mentioned known solutions all entail the adoption of drive shafts having eccentric portions that cooperate with the swift control bush, and this considerably complicates the construction of said shaft, with evident economical and functional drawbacks which are even worse in the solutions in which the shaft also has an axial cavity that accommodates the kinematic control systems that vary the tilt of the bush of the swift.

SUMMARY OF THE INVENTION

A principal aim of the present invention is to eliminate these drawbacks and others of known devices.

The invention has the important object of providing a turn separation device which has a significantly simplified structure and allows not only to vary the inclination of the swift supporting bush but also the extent of said inclination by means of an optionally gradual maneuver performed entirely from the outside of the feeder.

Another important object of the present invention is to provide a turn separation device which does not require a special construction of the drive shaft by virtue of the elimination of the eccentric portion of said shaft.

Another particular and important object of the invention is to provide a turn separation device which is entirely free from plays produced by wear and therefore from impacts and dynamic stresses that can compromise the integrity of the structure and the operation of the device.

Another object of the invention is to provide a turn separation device in which turn spacing can be easily set over a wide range of values and stably remains in the preset position without unwanted accidental variations.

Essentially, the device according to the invention uses an eccentric bush which is supported by a recessed coaxial portion of the drive shaft of the weft feeder. The bush is pivoted to said portion of the drive shaft by means of a diametrical pin, and its internal surface is profiled so as to form two portions of truncated-cone surfaces that lie mutually opposite at the respective smaller diameter, which is substantially equal to the diameter of the pin recessed coaxial portion of the shaft. The diametrical is arranged at said smaller diameter so that the bush can oscillate about said pin and be arranged at an angle with respect to the recessed portion of the shaft.

An active cam profile is formed on the front part of the bush and is engaged by two straddling movement pawls which are supported by a free disk which is rigidly coupled to the drive shaft by an actuation disk provided with an elastic coupling means that also acts as a position marking element for the mutual angular movements of the free disk and of the actuation disk.

The free disk, provided with the pawls cooperating with the front cam-shaped part of the bush, can be fixed in a preset position by a pushbutton stop device that protrudes from the front side of the drum of the weft feeder. When the free disk is fixed by means of the pushbutton stop device, the bush and the actuation disk are rotated manually by means of the flywheel of the windmilling arm and the movement pawls, by remaining fixed with respect to the profile of the cam of the rotating bush, vary the inclination of said bush in one direction or in the opposite direction according to the direction and extent of the rotation applied to the flywheel. The angular movements of the pawls with respect to the front cam of the bush are made stable by the elastic coupling and position-marking means associated with said actuation disk.

BRIEF DESCRIPTION OF THE DRAWINGS

The above characteristics, the purposes, and the advantages of the turn separation device according to the present invention will become apparent from the following detailed description and with reference to the accompanying drawings, which are given by way of non-limitative example and wherein:

FIGS. 11*a*, 11*b*, and 11*c* are diagrams of the movement of the swift when the bush is at its maximum tilt, obtained by rotating the flywheel of the windmilling arm counterclockwise;

FIGS. 12*a*, 12*b*, and 12*c* are diagrams of the movement of the swift when the bush is at its maximum tilt, obtained by rotating the flywheel of the windmilling arm clockwise.

DESCRIPTION OF THE PREFERRED EMBODIMENTS

Figure 1:
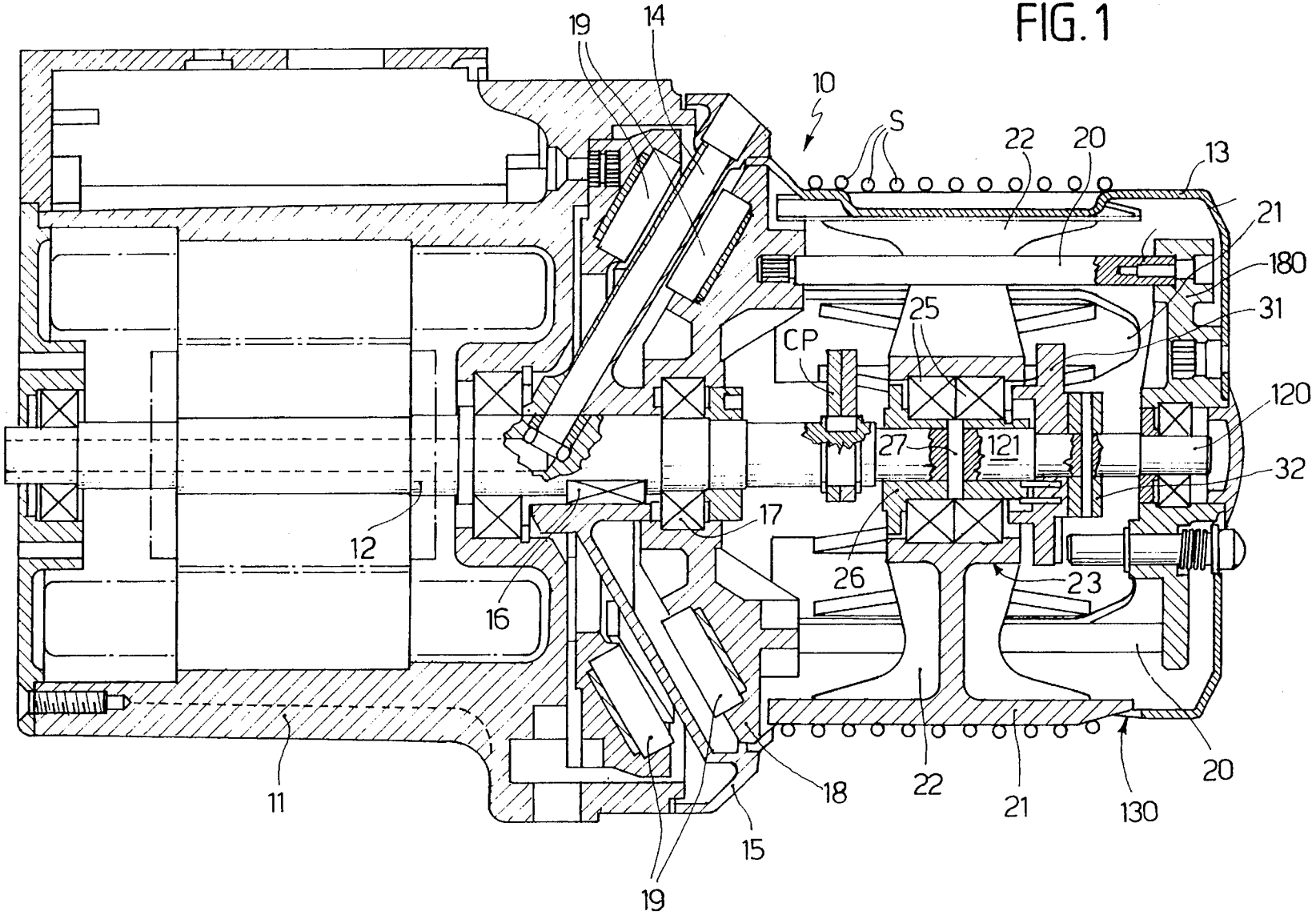
FIG. 1 is an axial sectional view of a weft feeder which includes the turn separation device according to the invention.

In the drawings, the reference numeral 10 generally designates a weft feeder which comprises a fixed base 11, a drive shaft 12, and a fixed drum 13 on which a hollow windmilling arm 14, associated with a flywheel 15, winds—in a per se known manner—multiple turns S of thread which constitute a thread reserve for the textile machine or loom to be fed.

The flywheel 15 associated with the windmilling arm 14 is keyed, by means of a key 16, to the drive shaft 12, which passes through a first flange 18 with bearings 17 interposed; said flange 18 supports the drum 13 and is rigidly coupled to the base 11 by means of mutually cooperating permanent magnets 19 which are arranged in facing pairs on the flange 18 and on the base 11. The drive shaft 12, which has dynamic balancing counterweights CP, lies inside the drum 13 and has one end 120 supported by a second flange 180 which is rigidly coupled to the first supporting flange 18 by spacer columns 20.

Figure 9:
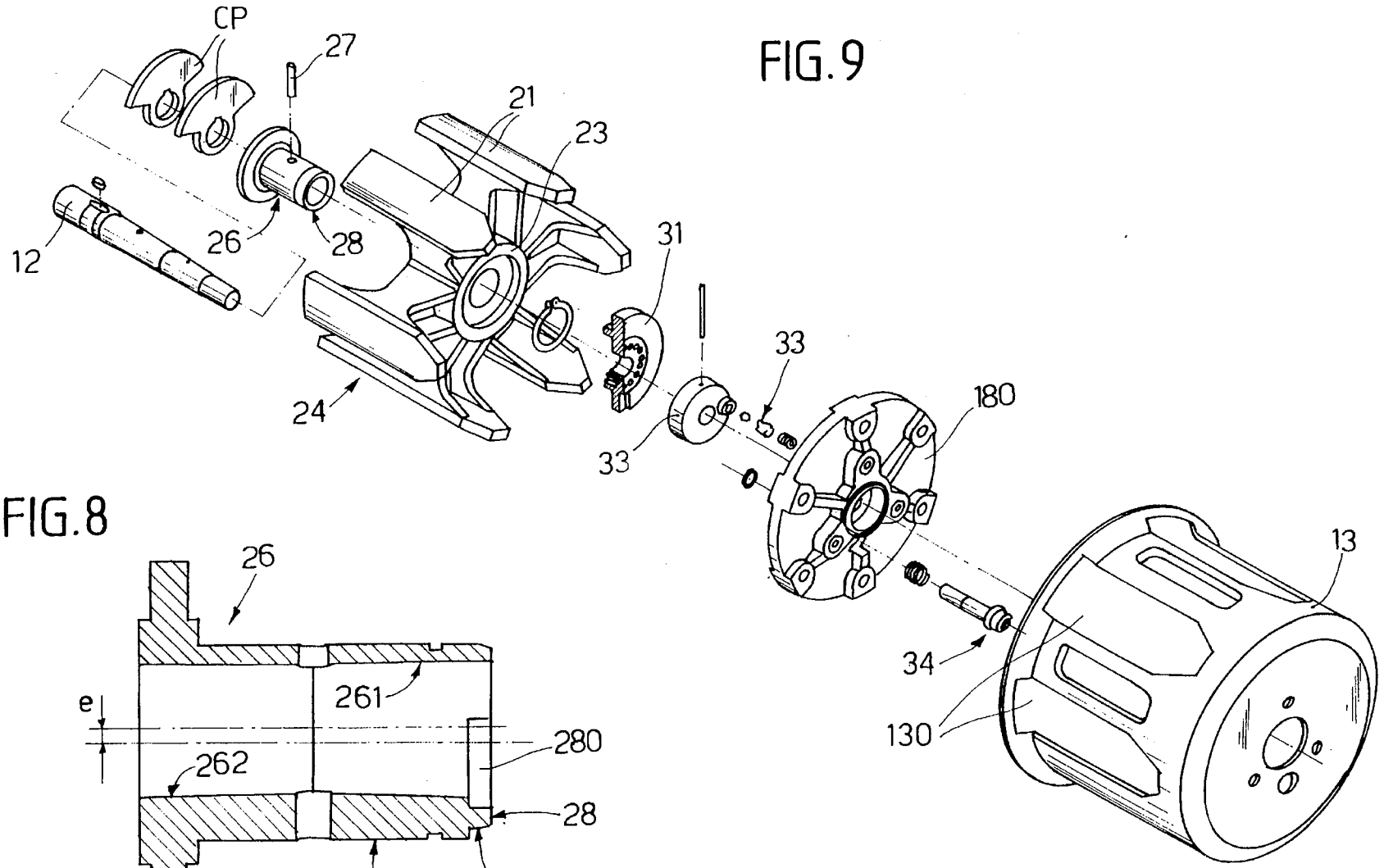
FIG. 9 is a general perspective exploded view of the turn separation device.

In a per se known manner, axial slots 130 are formed on the surface of the drum 13, and corresponding axial rods 21, connected by respective spokes 22 to a hub 23, variably protrude from them; the rods, the spokes and the hub form a swift 24 (FIG. 9).

Figure 3:
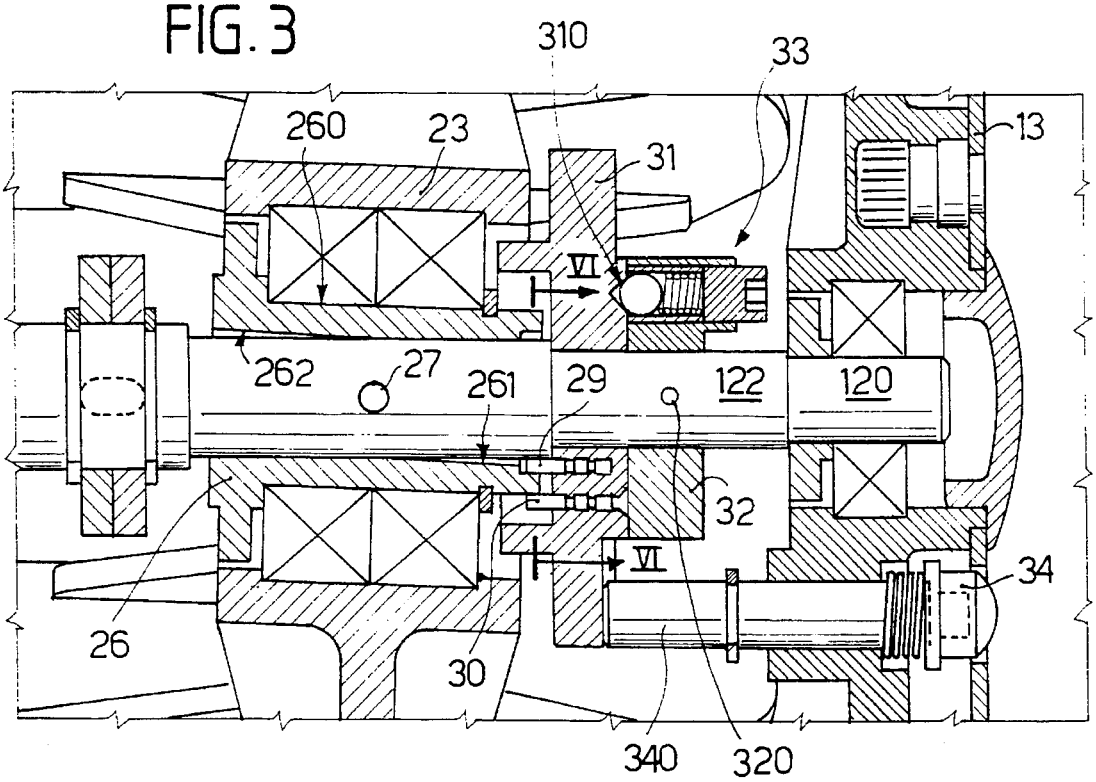
FIG. 3 is a detail view, similar to FIG. 2, of the bush in one of its two maximum inclination positions.
Figure 8:
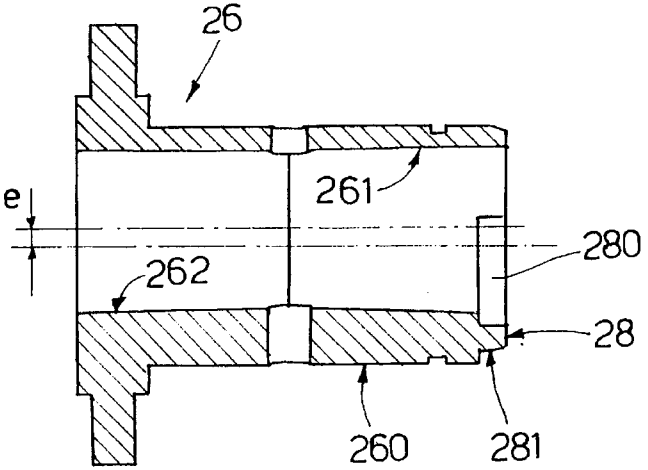
FIG. 8 is an enlarged-scale longitudinal sectional view of the bush.

As clearly shown in the figures, the hub 23 of the swift 24 is supported, with the interposition of bearings 25 fixed by means of a snap ring, by a bush 26 which is fitted on a recessed coaxial portion 121 of the shaft 12. The bush 26 is pivoted to the portion 121 of the shaft 12 by means of a diametrical pin 27 and has an eccentric cylindrical outer surface 260 and an internal surface which is profiled so as to form two truncated-cone surface portions 261–262 (FIG. 8) which are oppositely arranged at their respective smaller diameter, which is also substantially equal to the diameter of the recessed portion 121 of the shaft 12. The pin 27 is arranged at said smaller diameter so that the bush 26 can oscillate about the pin and be arranged at an angle with respect to the portion of the shaft 121 clockwise, as shown in FIG. 3, or counterclockwise, with reference to the plane of the drawing. The maximum inclination that the bush 26 can assume with respect to the axis of the shaft 121 is equal to twice the taper angle of the surfaces 261–262.

An active cam profile 28 is formed on the front part of the bush 26 and is delimited by two recessed circular arcs, respectively an inner one 280 and an outer one 281, both of which cover 180°; the inner arc is limited by shoulders 282–283. The active profile 28 is engaged by two straddling movement pawls 29–30 supported by a free disk 31 and engaging respectively the inner arc 280 and the outer arc 281 of the profile 28.

The free disk 31 is fitted so that it can rotate freely on a second recessed portion 122 of the shaft 12, and is kept in contact engagement against the shoulder 123 formed by the portion 121 by the action of an actuation disk 32 which is keyed, by means of a diametrical pin 320, on the same recessed portion 122 of the shaft 12.

Figure 4:
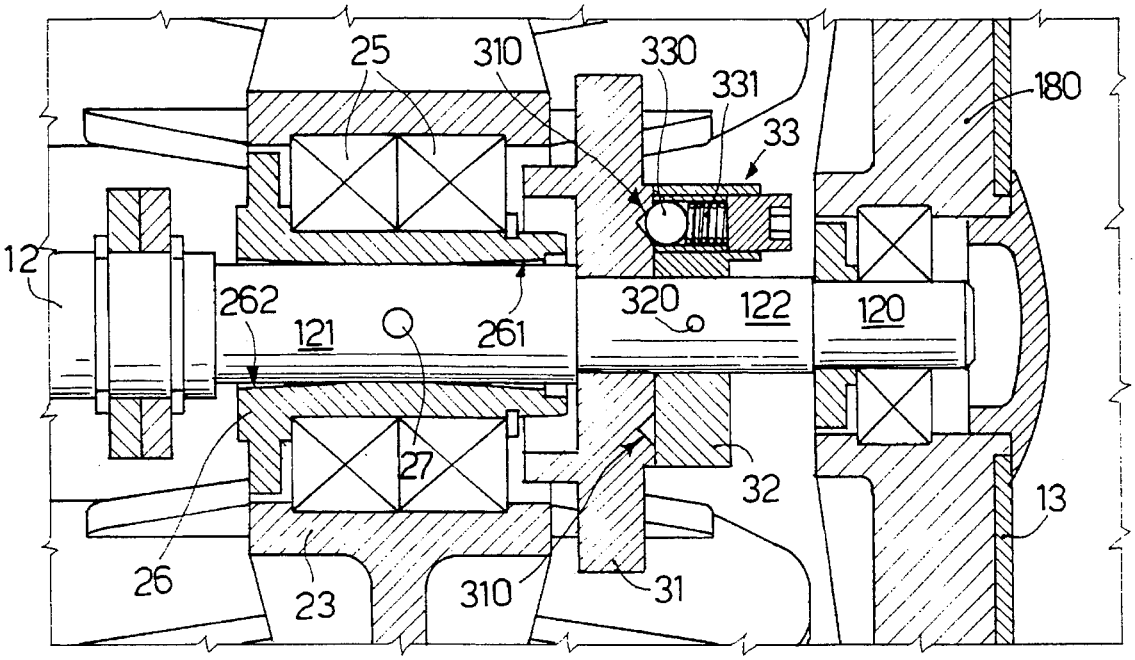
FIG. 4 is a sectional view, taken along the plane IV—IV of FIG. 2.
Figure 7:
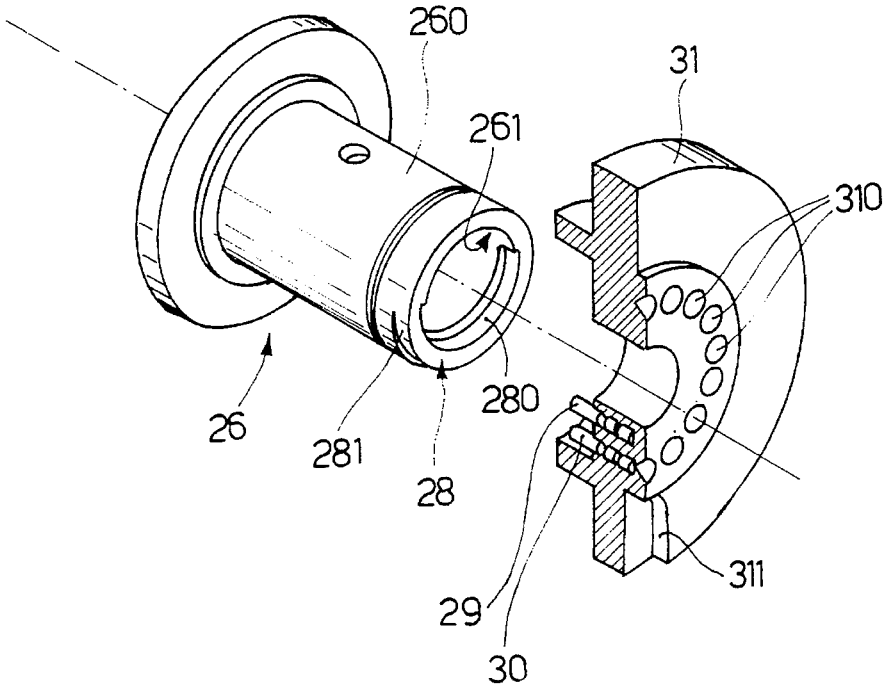
FIG. 7 is a perspective view of the detail of the bush and of the free disk associated therewith.

As clearly shown in FIG. 4, the actuation disk 32 has a means 33 for elastically coupling to the free disk 31, which also acts as a position-marking element for the mutual angular movements of the free disk 31 and of the actuation disk 32. The means 33 comprises a ball 330 which is actuated by a spring 331 so as to selectively engage a series of conical hollows 310 which are formed on the free disk 31 and are arranged so as to form a ring.

It is evident that the free disk 31 and the actuation disk 32 can rotate with respect to each other in angular steps that are equal to the spacing of the hollows 310 by moving the ball 330 in contrast with the action of the spring 331. The free disk 31 can be fixed in a preset angular position by a pushbutton stop device 34 which protrudes on the front side of the drum 13. The stop device 34 comprises a cylindrical pin 340 that can move in contrast with the action of a spring 341 and is suitable to engage, with its free end, a radial ridge 311 of the free disk 31.

As regards the adjustment of the inclination of the bush 26, the free disk 31 is fixed by means of the pushbutton stop device 34, whereas the bush 26 and the actuation disk 33 are rotated manually by means of the flywheel 15 of the wind-milling arm 14.

Figure 2:
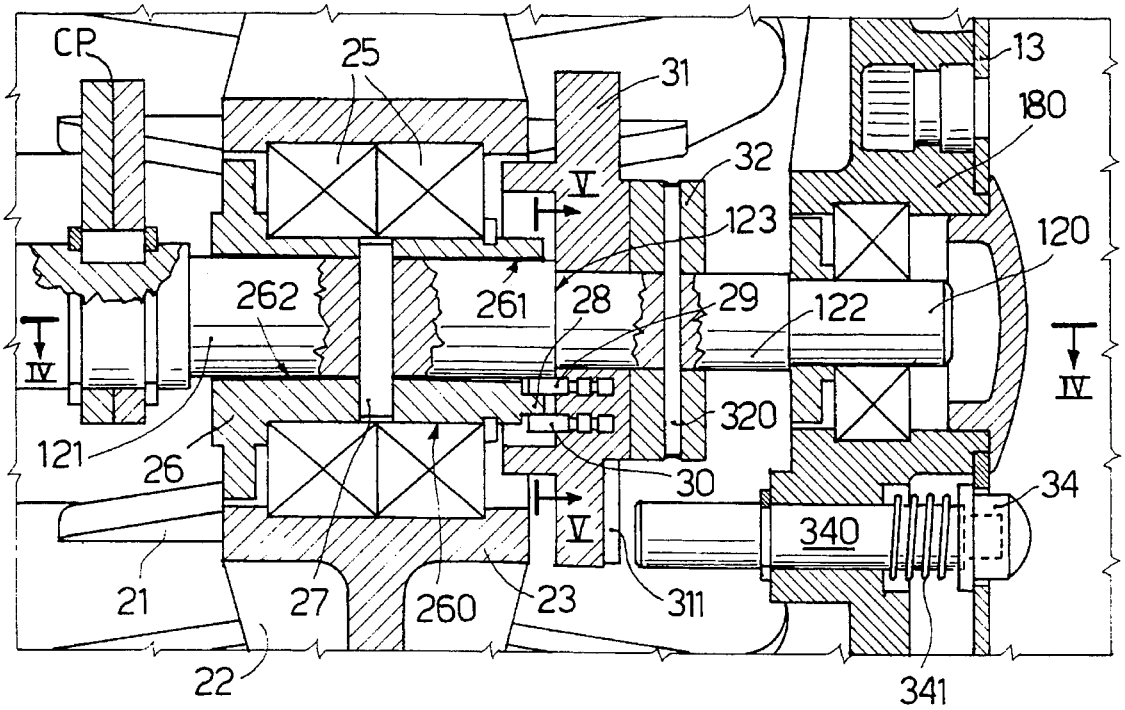
FIG. 2 is an enlarged-scale view of a detail of FIG. 1, illustrating the bush in the position in which its inclination is zero.
Figure 5:
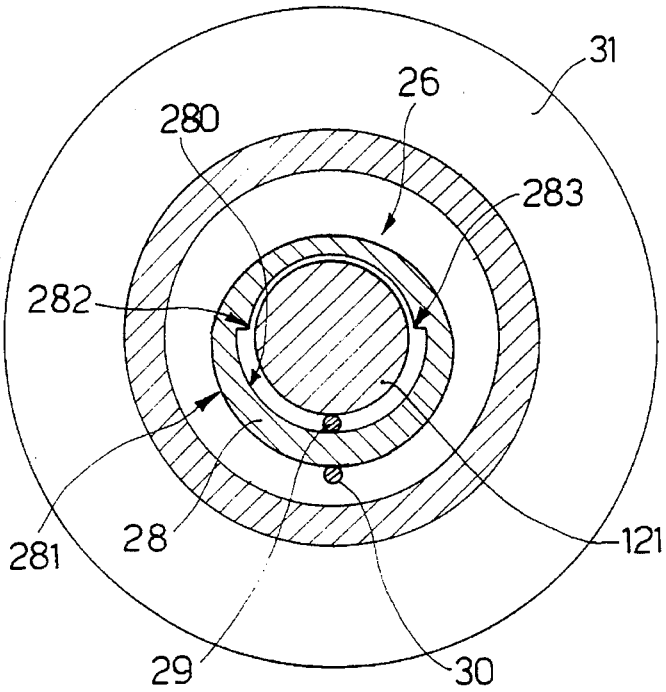
FIG. 5 is an enlarged-scale sectional view, taken along the plane V—V of FIG. 2.

Correspondingly, the pawls 29–30, which are fixed with respect to the active profile 28 that rotates rigidly with the bush, vary the inclination of the bush 26, which is maximum in one direction or the other, for a clockwise or counter-clockwise rotation of said bush through 90° with respect to the pawls 29–30 starting from the non-inclined position shown in FIGS. 2 and 5.

Figure 6:
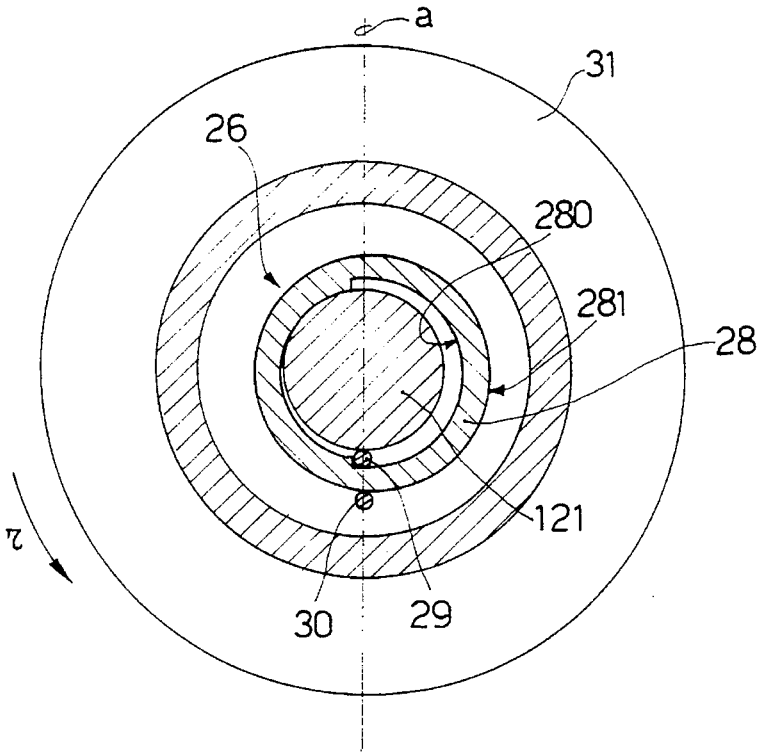
FIG. 6 is an enlarged-scale sectional view, taken along the plane VI—VI of FIG. 3.

FIG. 6 illustrates the maximum inclination of the bush 26, which is obtained by a counterclockwise rotation "r" of said bush with respect to the pawls 29–30. The maximum-inclination configuration of the bush for a clockwise rotation is obviously symmetrical with respect to the configuration of FIG. 6 with respect to the axis "a" shown in said figure.

Of course, the rotation of the bush 26 with respect to the disk 31 can be smaller than 90° and can be equal to the spacing of the hollows 310 or to a multiple thereof, so that each hollow is matched by a position for adjusting the inclination of the bush 26.

Once adjustment has been performed, the pushbutton 34 is released and the disk 31 rotates rigidly with the actuation disk 32, keeping its relative angular position unchanged with respect to said actuation disk; this position determines the inclination of the bush 26 and is made stable by the position-marking device 33.

The diagrams of FIGS. 10, 11, and 12, show the bush 26.

Figure 10A:
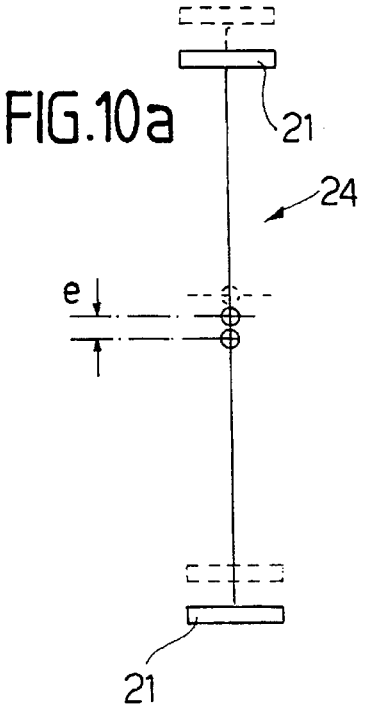
FIGS. 10*a*, 10*b*, and 10*c* are diagrams of the movement of the swift when the inclination of the bush is zero.
Figure 10B:
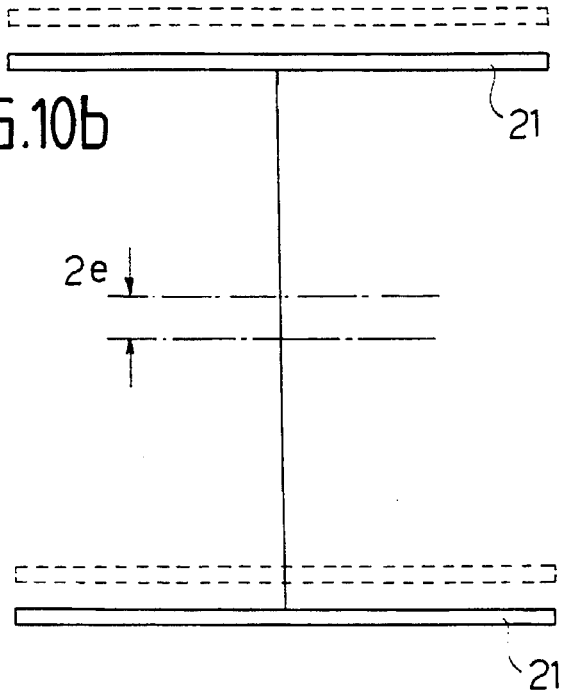
Figure 10C:
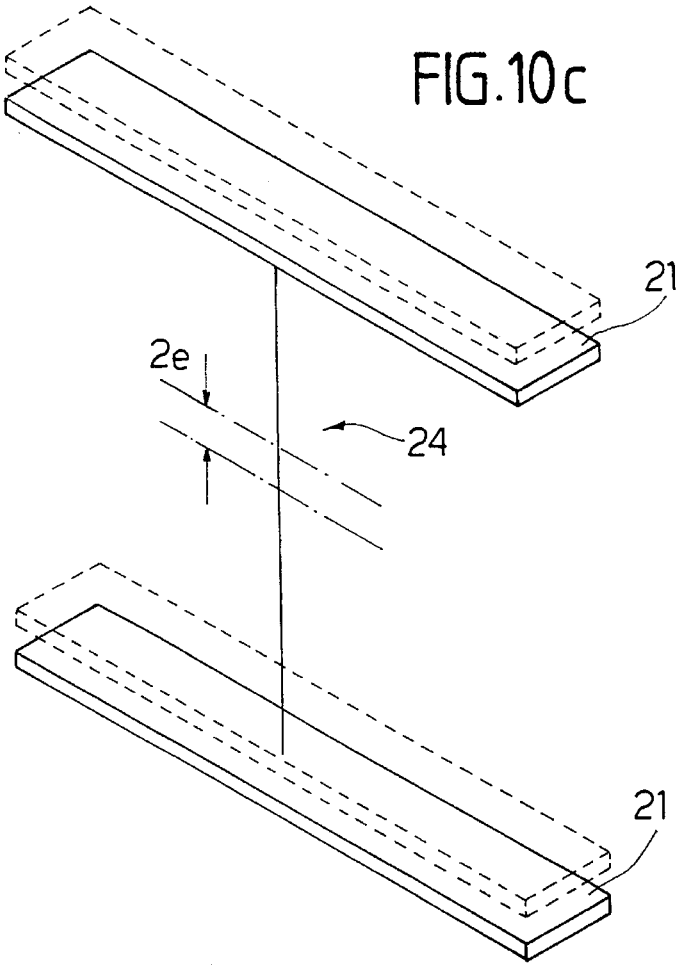

FIGS. 10*a*, 10*b*, and 10*c* relate to the movement of the swift when the bush 26 is not tilted.

In this case, the swift 24 only performs a oscillatory motion, the extent whereof is equal to 2*e*, where "e" is the eccentricity of the bush 26.

FIGS. 11*a*, 11*b*, and 11*c* relate to the movement of the swift 24 for a maximum inclination $\alpha$ of the bush 26, obtained by means of a counterclockwise rotation "r" of the bush 26 with respect to the pawls 29–30.

FIGS. 12*a*, 12*b*, and 12*c* relate to the movement of the swift 24 for an inclination $\alpha'$ of the bush 26, obtained by means of a clockwise rotation "r" of the bush 26 with respect to the pawls 29–30.

Of course, the details of execution and the embodiments may be altered extensively with respect to what has been described and illustrated by way of non-limitative example, without altering the concept of the invention and without thereby abandoning the scope of the invention defined by the appended claims.

What is claimed is:

1. A weft feeder including a device for separating the reserve turns of thread in the weft feeder, the weft feeder comprising:

a swift, formed by a set of axial rods;

a drum having a plurality of slots arranged to correspond to said rods when said swift is inserted into said drum; and a feeder drive shaft rotatable together with said swift with respect to said drum; the device comprising:

a bush mounted on a recessed coaxial portion of said drive shaft, said bush having a cylindrical eccentric outer surface and an internal surface that is profiled so as to form two portions of truncated-cone surfaces that lie mutually opposite at a respective smaller diameter of the truncated-cone surfaces, which is substantially equal to the diameter of said recessed coaxial portion of said shaft;

a diametrical pin arranged so as to cross said shaft and said bush and to bring about a pivotal engagement between said shaft and said bush, so that the bush can oscillate about said pin and be arranged at an angle with respect to said drive shaft;

an active cam profile, formed on a front part of said bush;

straddling movement pawls for engagement with said active cam profile;

a free disk supporting said straddling movement pawls, said pawls being supported on said free disk for sliding onto said active cam profile so as to vary the inclination of said bush when said bush is rotated with respect to said free disk; and a stop device which is mounted on said drum and interacts with said free disk to keep said free disk fixed when in an operating position.

2. A weft feeder according to claim 1, wherein said diametrical pin for pivoting said bush is arranged at a section of said bush that has the smaller diameter.

3. A weft feeder according to claim 1, wherein said active cam profile provided on said front part of said bush is delimited by recessed circular arcs, an inner one and an outer one, respectively, the inner arc being delimited by shoulders.

4. A weft feeder according to claim 3, wherein said inner and outer recessed circular arcs both cover 180°.

5. A weft feeder according to claim 1, wherein said free disk provided with said movement pawls is keyed so as to rotate freely on a second recessed portion of said drive shaft, and said free disk being rigidly coupled to said drive shaft by an actuation disk which is provided with an elastic coupling means which also acts as position-marking element for the mutual angular movements of said free disk and said actuation disk.

6. A weft feeder according to claim 5, wherein said actuation disk is keyed on said second recessed portion of said drive shaft by means of a diametrical pin.

7. A weft feeder according to claim 5, wherein said elastic coupling means, which acts as position-marking element and which is associated with said actuation disk, comprises a ball actuated by a spring so as to selectively engage a series of conical hollows which are provided on said free disk and are arranged so as to form a ring.

8. A weft feeder according to claim 7, wherein each said hollow is matched by a position for the adjustment of the inclination of said bush with respect to said drive shaft.

9. A weft feeder according to claim 1, wherein said stop device is in form of a pushbutton, which protrudes on a front side of said drum, said pushbutton device comprising a cylindrical pin, a spring arranged between said pin and a flange, so as to elastically contrast the movement of said pin, said pin being in turn arranged in a position such as to engage a radial ridge of said free disk.

* * * * *